US007329132B1

(12) United States Patent
Kamath et al.

(10) Patent No.: US 7,329,132 B1
(45) Date of Patent: Feb. 12, 2008

(54) LOW-INSERTION FORCE-LEVER CONNECTOR FOR BLIND MATING

(75) Inventors: Shashidhar M Kamath, Canton, MI (US); David Kwang, Southfield, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/497,031

(22) Filed: Jul. 31, 2006

(51) Int. Cl.
*H01R 13/62* (2006.01)

(52) U.S. Cl. ..... 439/157; 439/489; 439/488

(58) Field of Classification Search ..... 439/157, 439/489, 488
See application file for complete search history.

(56) References Cited

U.S. PATENT DOCUMENTS

| | | | | |
|---|---|---|---|---|
| 4,493,518 | A | 1/1985 | Asick | |
| 5,035,634 | A | 7/1991 | Hasircoglu et al. | |
| 5,037,321 | A | 8/1991 | Uratsuji et al. | |
| 5,181,857 | A | 1/1993 | Layser | |
| 5,275,573 | A | 1/1994 | McCleerey | |
| 5,490,797 | A | 2/1996 | Durgin | |
| 5,507,665 | A | 4/1996 | Oda | |
| 5,576,938 | A | 11/1996 | Beun | |
| 6,019,620 | A * | 2/2000 | Kodama et al. | 439/157 |
| 6,065,982 | A * | 5/2000 | Okabe | 439/157 |
| 6,126,470 | A | 10/2000 | Ono | |
| 6,254,414 | B1 * | 7/2001 | Sawayanagi et al. | 439/310 |
| 6,276,948 | B1 * | 8/2001 | Okabe | 439/157 |
| 6,296,510 | B1 * | 10/2001 | Daniels et al. | 439/372 |
| 6,338,646 | B1 | 1/2002 | Hara et al. | |
| 6,428,353 | B2 * | 8/2002 | Mochizuki | 439/545 |
| 6,450,827 | B1 | 9/2002 | Huang et al. | |
| 6,471,527 | B2 | 10/2002 | Fukamachi et al. | |
| 6,504,103 | B1 | 1/2003 | Meyer et al. | |
| 6,561,841 | B2 | 5/2003 | Norwood et al. | |
| 6,568,954 | B2 * | 5/2003 | Endo et al. | 439/489 |
| 6,666,698 | B2 * | 12/2003 | Beck et al. | 439/181 |
| 6,679,724 | B2 | 1/2004 | Hillman et al. | |
| 6,761,577 | B1 | 7/2004 | Koehler | |
| 6,824,421 | B2 | 11/2004 | Oka | |
| 6,827,599 | B1 | 12/2004 | Gattuso et al. | |
| 6,866,540 | B2 | 3/2005 | Robertson | |

FOREIGN PATENT DOCUMENTS

| | | |
|---|---|---|
| EP | 0 603 541 | 11/1993 |
| JP | 01132074 | 11/1987 |

* cited by examiner

*Primary Examiner*—Renee S. Luebke
*Assistant Examiner*—Vanessa Girardi
(74) *Attorney, Agent, or Firm*—Harness, Dickey & Pierce, P.L.C.

(57) ABSTRACT

An electrical connector according to the present teachings can be coupled together with a low insertion force. The electrical connector can utilize levers to create a mechanical advantage and reduce the input force required to couple the mating members together and interconnect the electrical terminals. When utilized as a blind mating electrical connector, the connector can include visual indicators indicative of the proper and complete coupling of the mating members and interconnection of the terminals.

27 Claims, 8 Drawing Sheets

LOW-INSERTION FORCE-LEVER CONNECTOR FOR BLIND MATING

FIELD

The present disclosure relates to a blind mating connector and, more particularly to a low insertion force blind mating connector with a lever.

BACKGROUND

The statements in this section merely provide background information related to the present teachings and may not constitute prior art.

Electrical connectors are used to electrically interconnect bundles of wires together. The connector can include complementary mating members. Each mating member includes wires that are to be electrically connected together. Each of the wires in one of the mating members can be coupled to a male terminal while each of the wires in the other one of the mating members can be coupled to a female terminal. When the two mating members are coupled together, the male and female terminals engage with one another to electrically interconnect the wires.

In blind electrical connectors, the mating of the terminals on the ends of the wires when coupling the two mating members together is visibly hidden from view. In other words, a person coupling the two mating members together cannot visually see the interconnection of the terminals with one another. Thus, in blind connectors, the proper and complete coupling of the mating members and of the terminals can be difficult to ascertain. Accordingly, it would be advantageous if the proper and complete mating of the mating members and of the terminals could be easily ascertained in a blind electrical connector.

Some electrical connectors may involve a large number of electrical wires that are to be interconnected, such as in a bus electrical center on a vehicle or stationary application. These large connectors typically include a large number of terminals and may require a significant amount of force to couple the mating members together and interconnect the electrical terminals. The required force can be greater than what can be reasonably applied manually. Typically, a mechanical assist is used to couple the mating members together due to the high insertion and extraction forces. The mechanical assist is typically provided by fasteners, such as bolts, which bring the mating members together and interconnect the terminals. The bolts are driven by a special tool, such as a torque gun, capable of applying a sufficient torque to the bolts so that the force imparted to the mating members is large enough to couple the mating members together and interconnect the terminals. The use of a torque gun, however, can limit the assembly location to locations where power and/or resources required by the torque gun are available. Limiting the assembly location can increase the manufacturing cost of assembling an item that uses these electrical connectors and can reduce manufacturing flexibility. Moreover, supplying the required resources in a desired assembly location increases the cost of that assembly location and still limits the assembly to that particular location.

Thus, it would be advantageous to have an electrical connector that needs a lower input force to be coupled together. Furthermore, it would be advantageous if the lower input force could be low enough to enable manual assembly of the electrical connectors. The manual assembly can advantageously facilitate the assembly of the electrical connectors at locations that are conducive to the manufacturing process and do not rely upon the need of special resources at the assembly location.

SUMMARY

An electrical connector according to the present teachings can be coupled together with a low insertion force. The electrical connector can utilize levers to create a mechanical advantage and reduce the input force required to couple the mating members together and interconnect the terminals. When utilized as a blind mating electrical connector, the connector can include visual indicators indicative of the proper and complete coupling of the mating members and interconnection of the terminals.

A connector assembly according to the present teachings can include a first connector having a section for securing a first plurality of electrical terminals to the first connector. The first connector can have an interior and have an opening to the interior opposite the securing section. The connector assembly can include a second connector having inner chambers for holding a second plurality of electrical terminals. The second connector can be complementary to the first connector such that a portion of the second connector can be disposed in the interior of the first connector to interconnect the first and second terminals. The connector assembly can also include at least one lever having first and second arms disposed on opposite first and second sides of one of the connectors with a bridge member joining the arms across the one connector. The first arm can have a pivot aperture disposed on a first pin projecting outwardly from the first side of the one connector and the second arm can have a slot longer than the aperture disposed on a second pin projecting outwardly from the second side of the one connector. At least one of the arms can have a coupling projection that engages with the other one of the connectors. Receipt of the second connector into the interior of the first connector engages the lever which thereby pivots and exerts a force on the coupling projection with the other one of the connectors pulling the second connector further into the first connector and electrically mating the first and second plurality of terminals.

A connector assembly according to the present teachings can have a first connector including a section for securing a first plurality of electrical terminals to the first connector. The first connector can have an interior and an opening to the interior opposite the securing section. The connector assembly can include a second connector sized to be inserted into the interior of the first connector. The second connector can have chambers for holding a second plurality of electrical terminals. The connector assembly can include an indicator coupled to one of the connectors. The indicator can pass through an opening located on a back side of the other one of the connectors when the first and second plurality of terminals are mated together thereby indicating electrical mating of the terminals.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Figure 1:
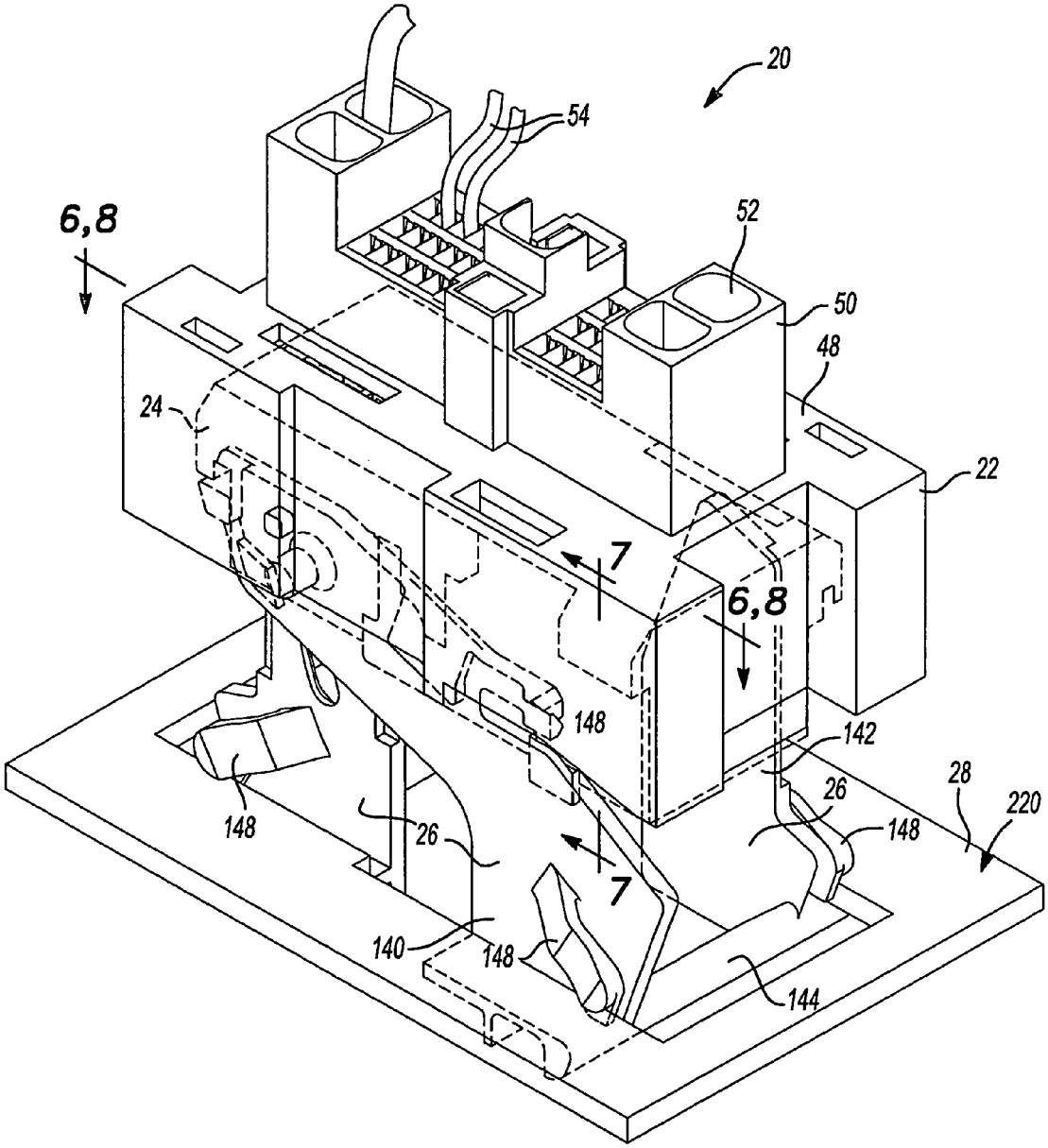
FIG. 1 is a perspective view of a connector according to the present teachings.
Figure 6A:
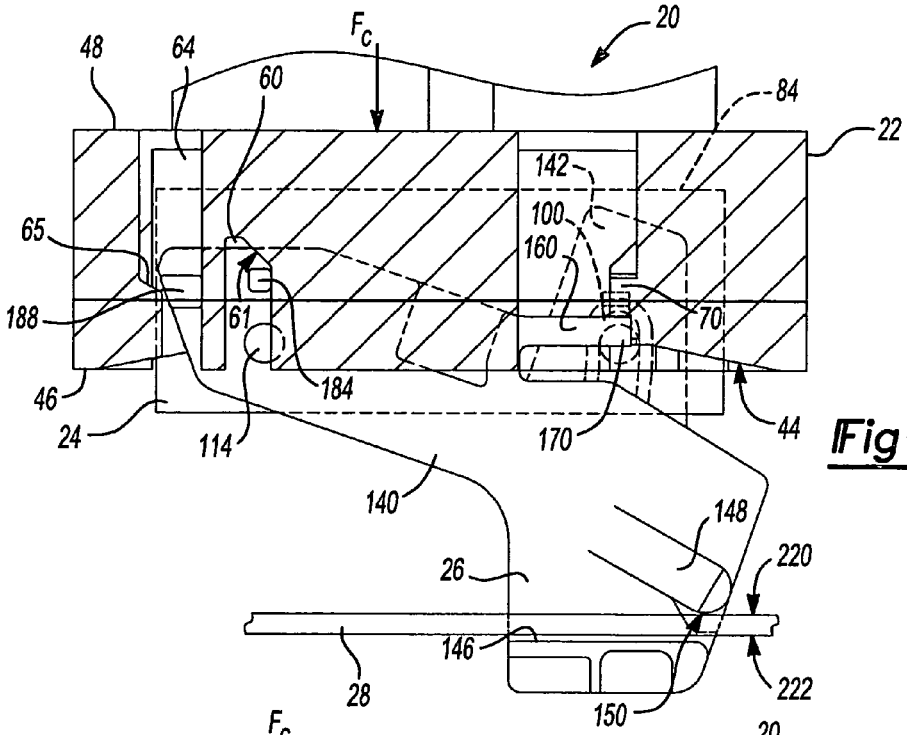
Figure 6B:
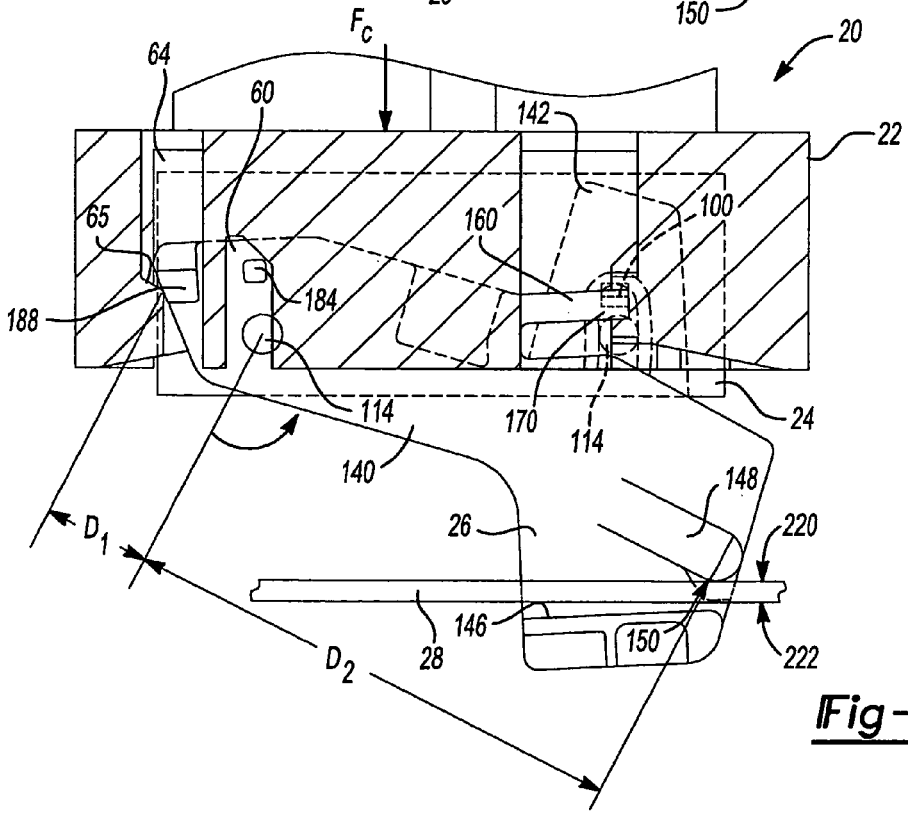
Figure 6C:
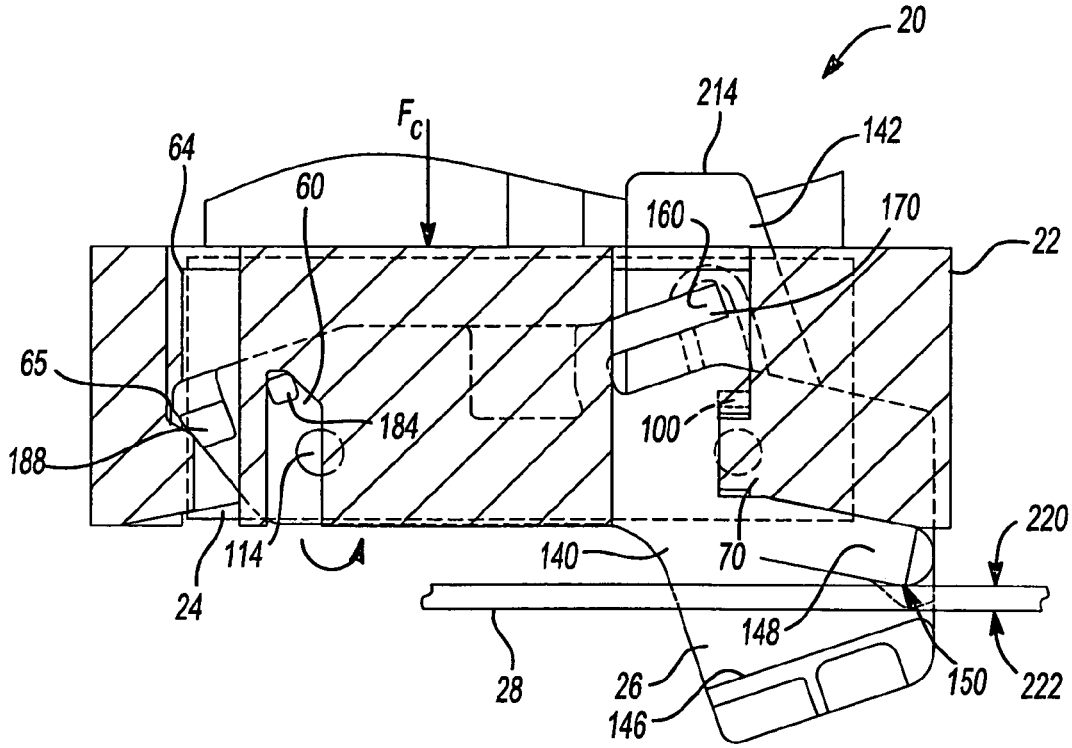
Figure 8:
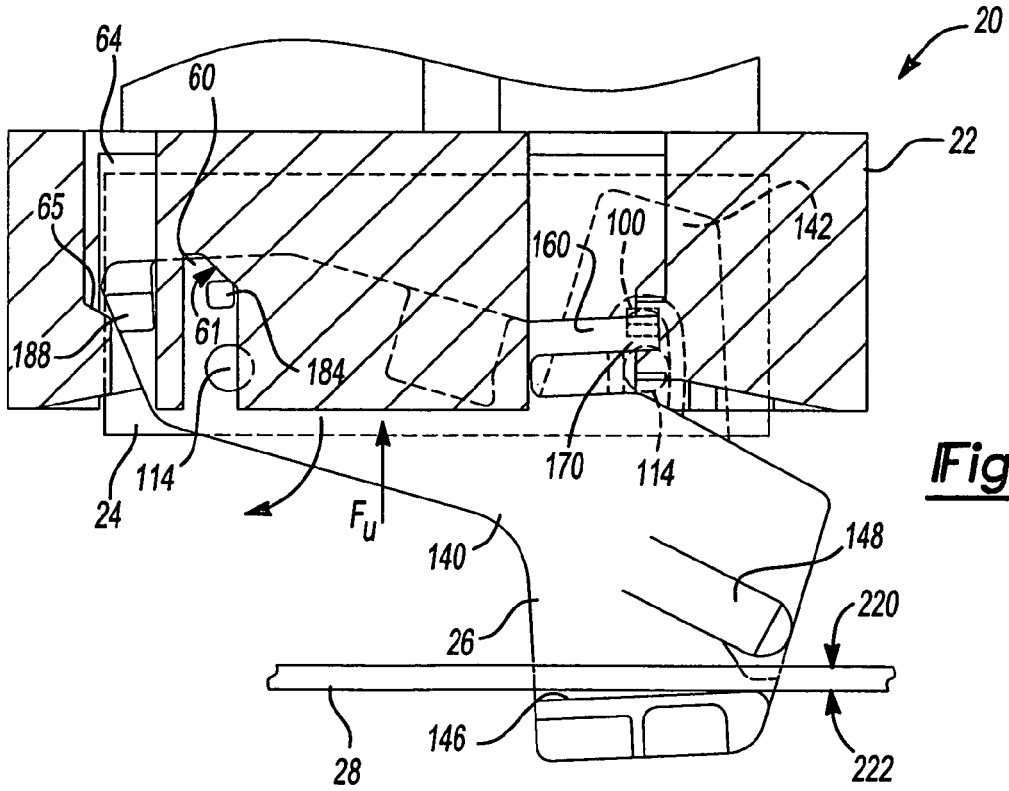

FIGS. 6A-C are cross-sectional views of the connector system along line 6-6 of FIG. 1 illustrating the coupling of the two mating members according to the present teachings;

FIGS. 7A-D are fragmented simplified cross-sectional views of the coupling of the mating members along line 7-7 of FIG. 1 illustrating the operation of the position preset feature according to the present teachings; and FIG. 8 is a cross-sectional view of the connector similar to that of FIG. 6A but illustrating the uncoupling of the mating members of FIG. 1.

DETAILED DESCRIPTION

The following description is merely exemplary in nature and is not intended to limit the present teachings, application, or uses.

Referring to FIG. 1, details of a connector according to the present teachings are shown. Connector 20 includes a male mating member 22 and a complementary female mating member 24 configured to be coupled together and interconnect electrical wires attached to each mating member. Female mating member 24 includes a pair of levers 26 that provide a mechanical advantage that facilitates the insertion and extraction of mating member 24 into and out of mating member 22, as described below. Female mating member 24 and levers 26 are configured to be disposed on a panel or base 28 to facilitate the coupling of mating members 22, 24 as described below.

Figure 2:
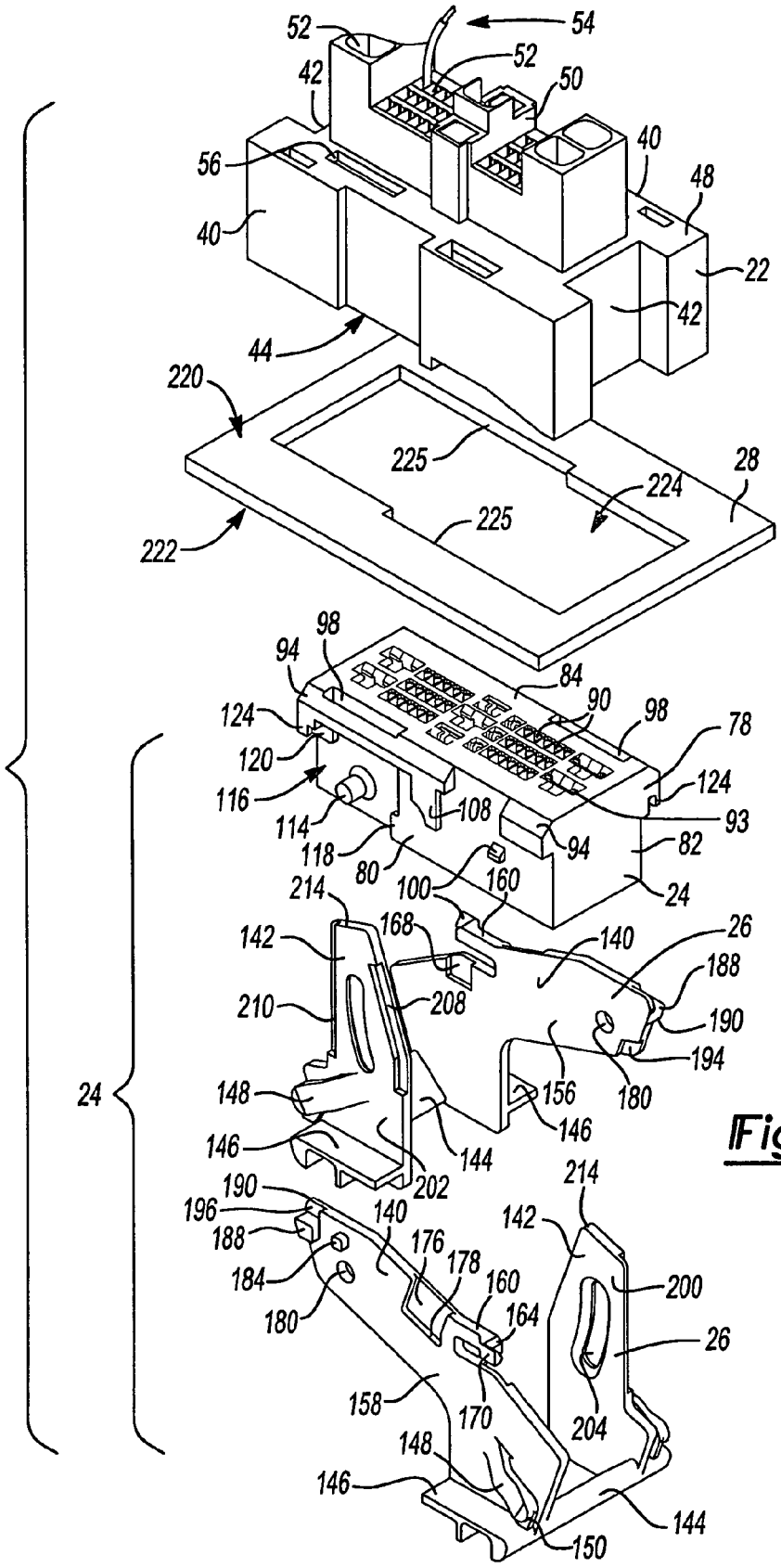
FIG. 2 is an exploded view of the connector of FIG. 1.
Figure 3:
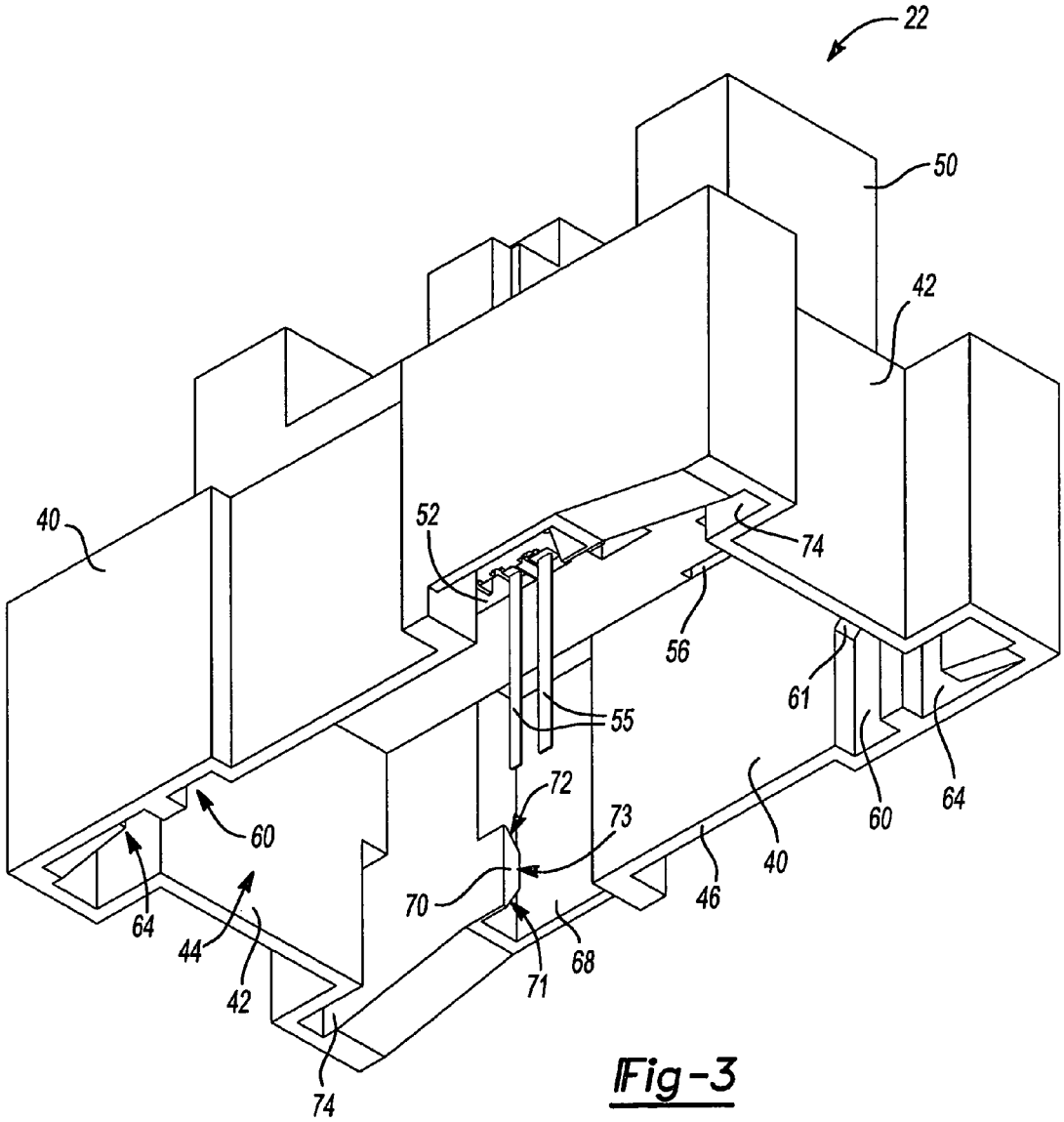
FIG. 3 is a perspective view of the male mating member of the connector of FIG. 1.

In FIGS. 2 and 3, male mating member 22 has a first pair of spaced-apart side walls 40 interconnected by a second pair of spaced-apart side walls 42. Side walls 40, 42 define an interior cavity 44 which is open on a front side 46. Cavity 44 is configured to receive mating member 24, as described below. A back side 48 of mating member 22 includes a terminal block 50 extending therefrom. Terminal block 50 includes a plurality of terminal openings 52 configured to receive wires 54 (which are only partially shown) having a male terminal 55 thereon. The wires 54 are inserted into openings 52 so that the male terminals 55 extend into interior cavity 44 from back side 48. Each terminal 55 can engage mating member 22 within an opening 52 to secure terminal 55 and the wire 54 in the associated opening 52 thereby securing the wire 54 and terminal 55 to mating member 22, as known in the art. Openings 52 can be of varying sizes to accommodate terminals of varying size. The varying terminal sizes can be associated with wires of differing gauge. Thus, male mating member 22 is configured to receive a plurality of male terminals that extend into cavity 44 from back side 48. The male terminals interconnect with female terminals on female mating member 24, as described below.

Mating member 22 includes various features that facilitate coupling to mating member 24 and can provide visual indication of a complete and proper coupling of mating members 22, 24. Indicator apertures 56 can be disposed on back side 48 on opposite sides of terminal block 50. Indicator apertures 56 can provide a visual indication of the complete and proper coupling of mating members 22, 24 and of the terminals therein, as described below. Interior cavity 44 also includes various features that facilitate the coupling of mating members 22, 24. Each side wall 40 includes first and second lever recesses 60, 64, respectively, that facilitate insertion and extraction of mating member 24 into and out of mating member 22 as described below. First and second lever recesses 60, 64 extend from front side 46 toward back side 48. First and second lever recesses 60, 64 include tapered surfaces 61, 65 (FIG. 6A), respectively, that facilitate the coupling and uncoupling.

Each side wall 40 also includes a preset position recess 68 that extends from front side 46 toward back side 48. Preset position recess 68 is configured to accommodate a portion of lever 26, as described below. A preset position release 70 having first and second tapered surfaces 71, 72 with flat surface 73 therebetween is disposed adjacent preset position recess 68 adjacent front side 46. Each side wall 40 also includes a guide recess 74 which extends from front side 46 toward back side 48. Guide recess 74 helps retain the arms of lever 26 in the proper position, as described below.

Figure 4:
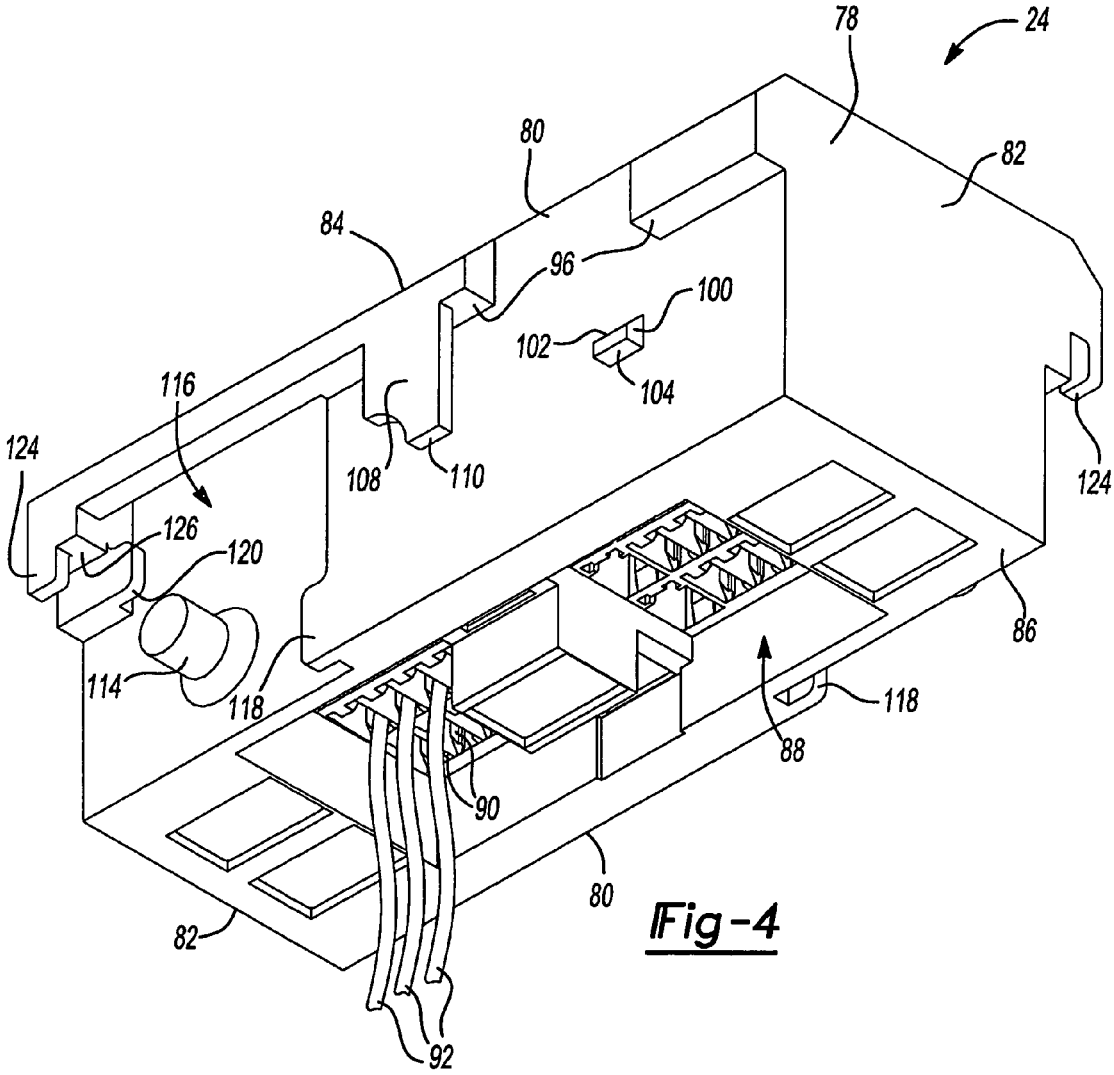
FIG. 4 is a perspective view of a portion of the female mating member of FIG. 1.

In FIGS. 2 and 4, female mating member 24 includes a body 78 that can have a pair of spaced-apart side walls 80 interconnected by a second pair of spaced-apart side walls 82. The body 78 can be sized to be received into interior cavity 44. Mating member 24 can include a front side 84 and a back side 86. A terminal block 88 is formed in back side 86 and extends toward front side 84. Terminal block 88 includes a plurality of openings 90 that are configured to receive wires 92 having female terminals 93 thereon (which are only partially shown). Openings 90 can extend through terminal block 88 from back side 86 to front side 84. The female terminals 93 can engage body 78 within openings 90 in a manner that is well known in the art and secure the wires 92 to terminal block 88. Openings 90 in front side 84 align with the male terminals 55 (FIG. 3) protruding into interior cavity 44 of female mating member 22 to allow the male terminals 55 to enter into and electrically interconnect with the female terminals 93 on female mating member 24 when mating members 22, 24 are coupled together. Openings 90 can be of varying sizes to accommodate terminals of varying sizes. The varying terminal sizes can be associated with wires of differing gage.

Mating member 24 includes various features that facilitate the coupling of mating members 22, 24 together. Side walls 80 each include a tapered edge 94 that tapers outwardly from front side 84 as it extends toward back side 86. Tapered edges 94 may engage with front side 46 of mating member 22 when coupling mating members 22, 24 together. The tapering of edge 94 facilitates alignment of mating member 24 with interior cavity 44 of mating member 22. A flat surface 96 is disposed on the back side of tapered edge 94 and can be substantially parallel with back side 86. Flat surface 96 can aid in limiting relative movement of lever 26.

Mating member 24 includes a pair of indicator arm guides 98 that align with indicator apertures 56. Side walls 80 can each include a preset position projection 100 extending outwardly therefrom. Preset position projection 100 can include a tapered surface 102 that generally faces front side 84 and a flat surface 104 that generally faces back side 86 and extends substantially perpendicularly outwardly from side wall 80. A guide member 108 can extend from a portion of tapered edge 94 toward back side 86 and can be spaced apart from side wall 80 by a distance that permits lever 26 to be received between guide member 108 and side wall 80. A back surface 110 of guide member 108 can function as a stop to limit the movement of lever 26 relative to mating member 24, as described below.

A pivot pin 114 extends outwardly from each side wall 80 adjacent opposite side walls 82. Each pivot pin 114 serves as a fulcrum for the engagement arm of one of the levers 26 and also serves as an alignment member for the indicator arm of the other lever 26, as described below. Pivot pins 114 extend outwardly from a recess 116 in each side wall 80. Guide members 118, 120 are spaced apart from recess 116 and function to guide the indicator arms of levers 26. Another guide 124 is spaced outwardly from guide 120 with a flat surface 126 facing back side 86. Guide 124 and flat surface 126 can function to limit relative movement of levers 26.

Figure 5:
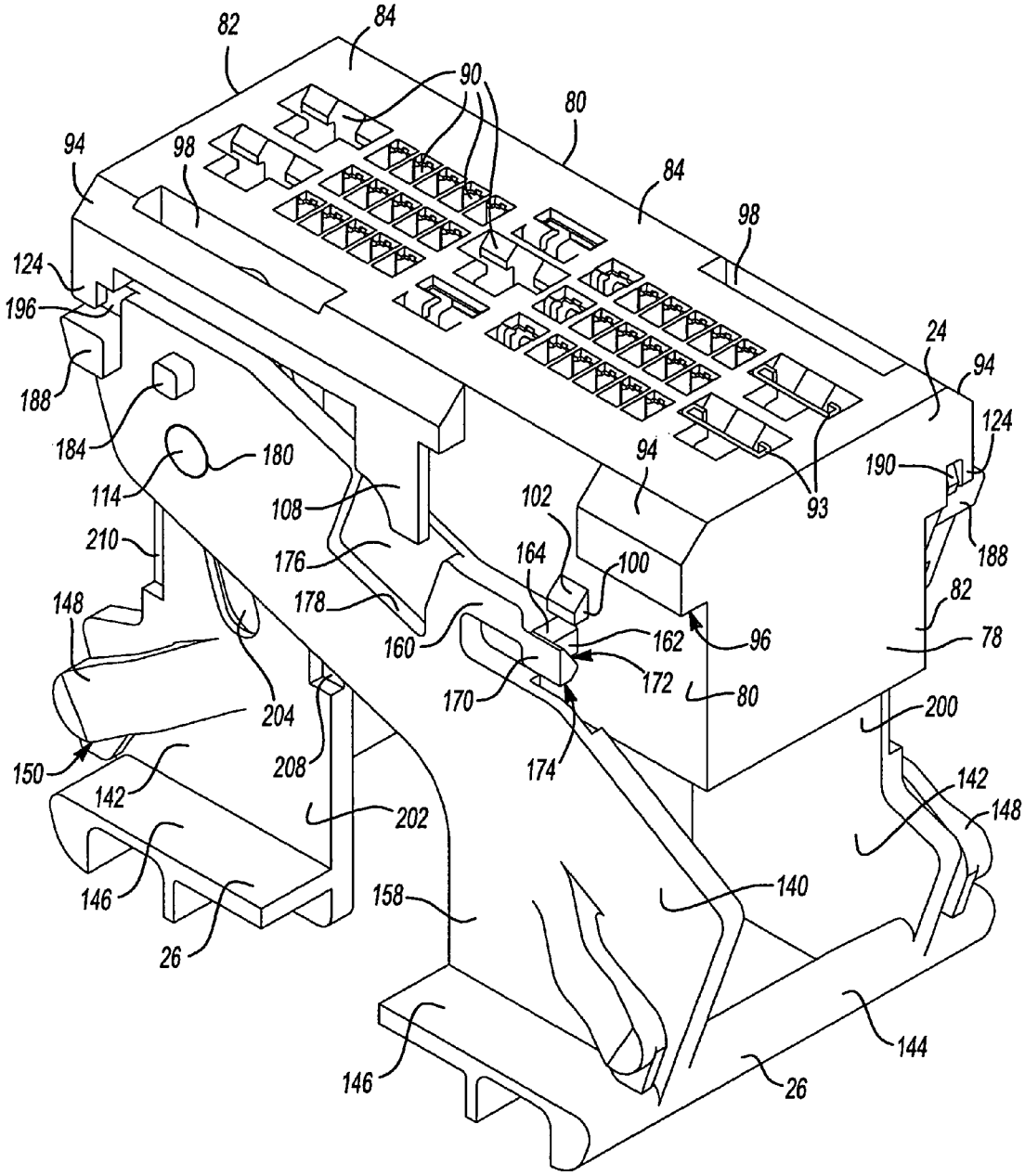
FIG. 5 is a perspective view of the female mating member of FIG. 1.

With additional reference to FIGS. 2 and 5, each lever 26 includes an engagement arm 140 and an indicator arm 142. Arms 140, 142 are spaced apart by a bridge 144 so that each arm 140, 142 is adjacent a different one of side walls 80 on body 78 and bridge 144 extends across back side 86 between side walls 80 and adjacent side walls 82. Bridge 144 includes a pair of lips 146 that extend outwardly beyond arms 140, 142. Lips 146 engage with panel 28 during the coupling of mating members 22, 24 as described below. Each arm 140, 142 includes panel lock arm 148 extending outwardly therefrom. Panel lock arms 148 include a rounded surface 150 that engages with the opposite side of panel 28. Panel lock arms 148 can be flexed toward arms 140, 142 to facilitate the insertion of mating member 24 and levers 26 through panel 28, as described below. Panel lock arms 148 function to maintain levers 26 and mating member 24 attached to panel 28 and to transmit coupling and uncoupling forces from panel 28 to levers 26.

Engagement arm 140 includes opposite inner and outer surfaces 156, 158, respectively. Engagement arm 140 includes a preset position arm 160 that engages with preset position projection 100 to retain levers 26 in a preset position prior to the coupling of mating members 22, 24, as described below. Preset position arm 160 includes a first portion 162 that engages with preset position projection 100 on mating member 24. First portion 162 includes a flat surface 164 that faces front side 84 of mating member 24. Flat surface 164 engages with flat surface 104 of preset position projection 100. A second portion 170 of preset position arm 160 includes a first tapered surface 172 that generally faces front side 84 of body 78 and a second tapered surface 174 that generally faces back side 86 of body 78. Second portion 170 of preset position arm 160 engages with preset position release 70 (FIG. 3) during the coupling and uncoupling of mating members 22, 24, as described below. Preset position arm 160 fits within preset position recess 68 (FIG. 3) in mating member 22 when mating members 22, 24 are coupled together. Engagement arm 140 includes a recess 168 on inner surface 156. Recess 168 is configured to accommodate preset position projection 100 when mating members 22, 24 are coupled together. Engagement member 140 also includes another recess 176 in outer surface 158. Recess 176 is configured to allow the portion of engagement arm 140 over which recess 176 extends to fit between guide member 108 and side wall 80 of mating member 24. The bottom of recess 176 includes a flat surface 178 that can engage with back surface 110 of guide member 108 to function as a stop.

An opening 180 extends through engagement arm 140 adjacent its end and the pivot pin 114 is received therethrough, thereby permitting engagement arm 140 to rotate about pivot pin 114. An uncoupling projection 184 extends outwardly from outer surface 158 of engagement arm 140 adjacent opening 180. Uncoupling projection 184 fits within first lever recess 60 (FIG. 3) in mating member 22. Uncoupling projection 184 functions to facilitate the uncoupling of mating members 22, 24, as described below. A coupling projection 188 extends outwardly from outer surface 158 of engagement arm 140 at the tip 190 thereof. Coupling projection 188 fits within second lever recess 64 (FIG. 3) of mating member 22. Coupling projection 188 facilitates the coupling of mating members 22, 24 together, as described below. A recess 194 is disposed on inner surface 156 of engagement arm 140 adjacent tip 190. Recess 194 accommodates a portion of panel lock arm 148 when mating members 22, 24 are coupled together. A recess 196 is disposed on outer surface 158 of engagement arm 140 adjacent tip 190. Recess 196 is retained by projection 124 such that lever arm 26 is not dislodged during handling.

Indicator arm 142 has an inner surface 200 that faces side wall 80 and an opposite outer surface 202. An arcuate slot 204 is disposed in indicator arm 142 and is sized to receive the pivot pin 114 that is located on a side of body 78 opposite the associated engagement arm 140. Slot 204 guides the rotation of lever 26 about the pivot pin 114 disposed in opening 180 of engagement arm 140. Recesses 208, 210 are located on outer surface 202 of indicator arm 142 adjacent the edges. Recesses 208, 210 extend along a portion of a length of indicator arm 142 and are configured to engage with guides 118, 120, respectively, to guide the movement of indicator arm 142. Indicator arm 142 can include an indicator 214 that can extend through indicator arm guide 98 of body 78 and indicator aperture 56 of mating member 22 when mating members 22, 24 are coupled together. Indicator 214 can be configured to extend all the way through indicator aperture 56 when complete and proper coupling of mating members 22, 24 is achieved. Alternatively, indicator 214 can be configured to be flush with or visible through indicator aperture 56 when mating members 22, 24 are completely and properly coupled together. In this manner, indicator 214 can provide a visual indication to a user of the proper and complete coupling of mating members 22, 24 together. The proper coupling together of mating members 22, 24 also corresponds to the interconnection of terminals 55 (FIG. 3) with terminals 93 (FIG. 2). Indicator 214 can be colored differently than back side 48 of mating member 22 to enhance the visual indication.

Levers 26 are configured to be attached to body 78 with each bridge 144 extending along back side 86 between side walls 80 adjacent side walls 82. Engagement arms 140 of each lever 26 extend along opposite side walls 80 of mating member 24. Similarly, indicator arms 142 of each lever 26 extend along opposite side walls 80 of body 78. Indicator arm 142 of each lever 26 is sandwiched between the engagement arm 140 of the other lever 26 and a side wall 80 of mating member 24. Slot 204 of each indicator arm 142 is disposed on pivot pin 114 with guides 118, 120 engaged in recesses 208, 210, respectively, and with indicator 214 disposed in indicator arm guide 98. Opening 180 of engagement arm 140 is engaged with pivot pin 114 with tip 190 disposed behind guide 124. Guide member 108 is disposed in recess 176. Preset position arm 160 is engaged with preset position projection 100 so that levers 26 are in their preset position, as shown in FIG. 5. In this position, movement of levers 26 toward front side 84 of mating member 24 is prevented.

Mating member 24 is configured to be attached to panel 28. Panel 28 includes opposite surfaces 220, 222 with an opening 224 extending therethrough. Opening 224 is configured to allow portions of body 78 and levers 26 to pass therethrough. When inserting mating member 24 through opening 224, panel lock arms 148 are compressed inwardly by the sidewalls 225 of opening 224 to pass through opening 224. Lips 146 of bridge 144 are too wide to pass through opening 224. As a result, once panel lock arms 148 pass through opening 224 and are released from the sidewalls 225, the panel lock arms 148 spring outwardly such that panel 28 is disposed between lips 146 and panel lock arms 148. First surface 220 of panel 28 can engage with rounded surface 150 of panel lock arms 148 while second surface 222 can engage with lips 146. This condition is illustrated in FIG. 1. The wires 92 with the female terminals 93 (FIG. 2) thereon may be secured to body 78 prior to or after the coupling of mating member 24 to panel 28. Mating member 24 can undergo limited movement relative to panel 28 when disposed within opening 224.

Panel 28 can be fixed in place while mating member 22 can be moved toward and engaged to mating member 24. FIGS. 6A through 6C illustrate the coupling of mating members 22, 24 (for purpose of clarity, only one of the levers 26 has been shown). In FIG. 6A, mating member 22 is aligned with mating member 24 so that front side 84 of mating member 24 faces front side 46 of mating member 22 and is aligned with interior cavity 44. Mating member 22 is moved toward panel 28 with coupling force $F_c$ being applied to mating member 22 in a coupling direction.

Figure 7A:
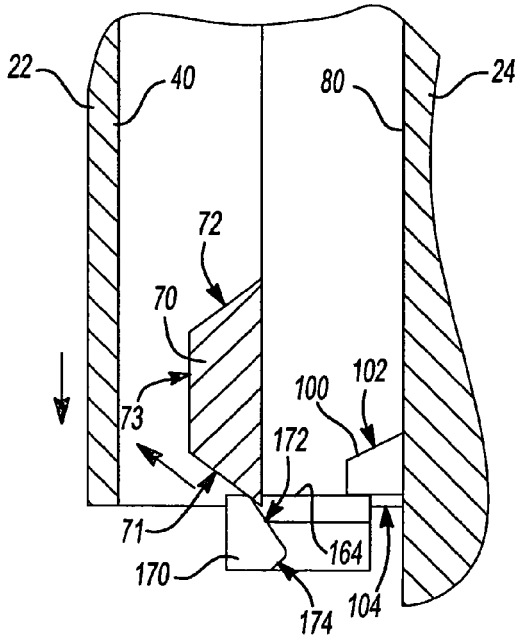
Figure 7B:
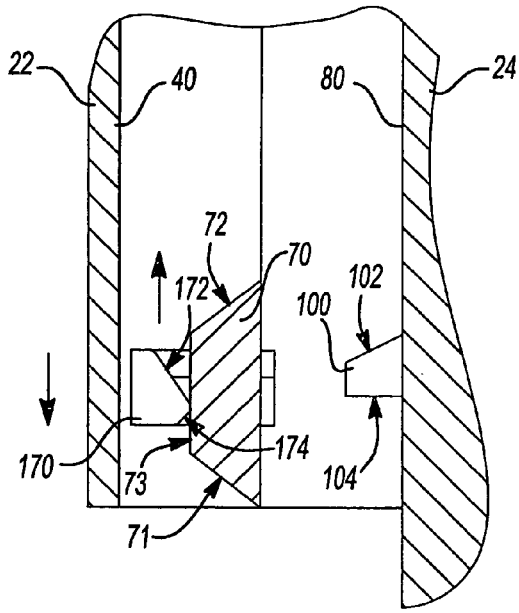

During the initial coupling of mating member 22 with mating member 24, levers 26 remain in the preset position due to the engagement of preset position projection 100 with preset position arm 160. More specifically, flat surface 164 (FIG. 5) on preset position arm 160 is abutted against flat surface 104 (FIG. 4) of preset position projection 100. This engagement continues until preset position arm 160 is disengaged from preset position projection 100 by preset position release 70. The releasing of preset position arm 160 from preset position projection 100 is initiated in FIG. 6B and shown in more detail in FIGS. 7A-7D. With reference to FIGS. 6B and 7A, mating member 22 is moved relative to mating member 24 in the coupling direction so that second portion 170 of preset position arm 160 engages with preset position release 70. During initial engagement, first tapered surface 172 of second portion 170 engages with first tapered surface 71 of preset position release 70 thereby causing preset position arm 160 to move away from side wall 80 of mating member 24 and toward side wall 40 of mating member 22. As mating member 22 continues to move relative to mating member 24 in the coupling direction, second portion 170 moves along flat surface 73 of preset position release 70. Disengagement of preset position arm 160 from preset position projection 100 as shown in FIG. 7B permits lever 26 to pivot about pivot pin 114 and move relative to body 78. As lever 26 moves relative to mating member 24, indicator arm 142 slides within guides 118, 120 and 98 (FIG. 2) and slot 204 slides along opposite pivot pin 114.

Figure 7C:
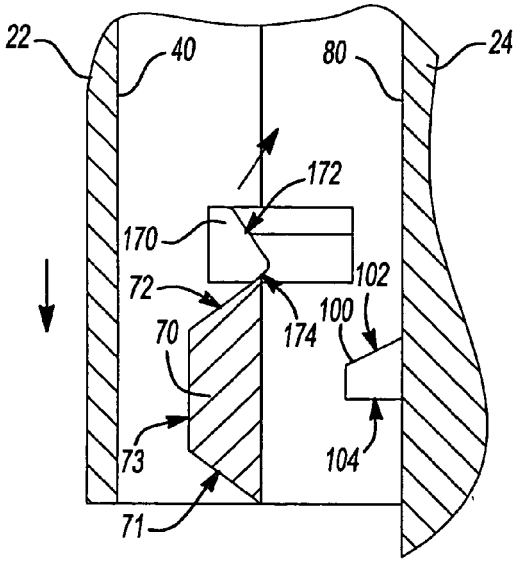
Figure 7D:
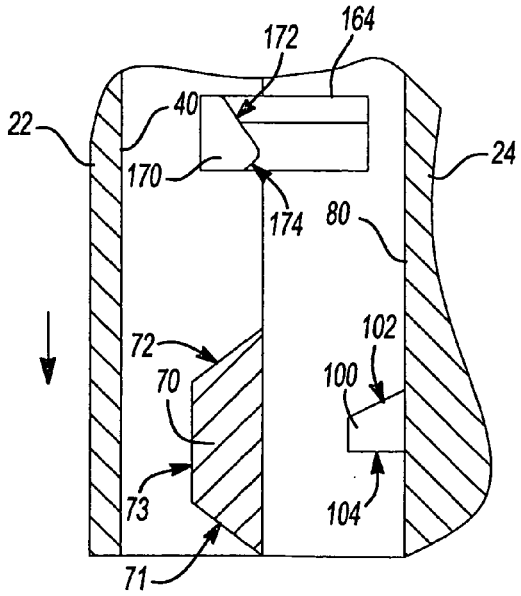

With reference to FIGS. 6C, 7C and 7D, continued movement of mating member 22 relative to mating member 24 in the coupling direction continues to cause relative movement between lever 26 and body 78 and eventually results in second tapered surface 174 of second portion 170 sliding along second tapered surface 72 of preset position release 70. Movement of second portion 170 along second tapered surface 72 allows preset position arm 160 to move toward side wall 80 of body 78 due to the resilient nature of preset position arm 160, as shown in FIG. 7C. Continued relative movement between mating members 22, 24 in the coupling direction eventually results in preset position arm 160 returning to its relaxed state and being free of engagement with preset position projection 100 as shown in FIG. 7D. Lever 26 is then free to pivot about pivot pin 114 due to the coupling force $F_c$ being applied to mating member 22 and transferred to lever 26 via engagement between first surface 220 of panel 28 and panel lock arm 148, as shown in FIG. 6C.

Referring back to FIGS. 6A-6C, as mating member 22 moves relative to mating member 24 in the coupling direction, uncoupling and coupling projections 184, 188 move along first and second lever recesses 60, 64 toward back side 48 of mating member 22 such that uncoupling projection 184 engages with tapered surface 61 of first lever recess 60, which pushes coupling projection 188 toward tapered surface 65 of second lever recess 64. This movement causes lever 26 to pivot about pivot pin 114 and, as a result, coupling projection 188 to engage with tapered surface 65. The resulting interactions between coupling projection 188 with tapered surface 65 and rounded surface 150 of panel lock arm 148 on first surface 220 of fixed panel 28 allows lever 26 to amplify the coupling force $F_c$ based on the relative distances of the surface interactions from pivot pin 114 which is now acting as a fulcrum point. The distance $D_1$ between pivot pin 114 and engagement of coupling projection 188 with tapered surface 65 is significantly less than the distance $D_2$ between the center of pivot pin 114 and the engagement between panel lock arm 148 and first surface 220 of panel 28. In the particular example provided, $D_2 \geqq 4.4*D_1$. Thus, a mechanical advantage is realized and continued application of coupling force $F_c$ is amplified. As those of ordinary skill in the art will appreciate, the mechanical advantage can be employed to initiate and/or complete the coupling of terminals 55 (FIG. 3) with terminals 93 (FIG. 2). In this way, the coupling force $F_c$ exerted by a technician assembling the mating members 22, 24 can be relatively low, even when relatively large numbers of terminal connections and/or relatively large terminals are coupled together.

As coupling force $F_c$ is continued to be applied to mating member 22, lever 26 continues to pivot about pivot pin 114 and engagement between coupling projection 188 and tapered surface 65 pulls mating members 22, 24 together until a complete coupling is achieved, as shown in FIG. 6C. Additionally, as mating members 22, 24 couple together, indicator 214 on indicator arm 142 extends into and through indicator aperture 56 (FIG. 2) in mating member 22. As a result, once a complete and proper coupling of mating members 22, 24 is achieved, indicator 214 extends beyond back side 48 of mating member 22 thereby providing a visual indication of a complete and proper coupling of mating members 22, 24 together. The degree to which indicator 214 extends beyond back side 48 can be configured as desired. For example, indicator 214 can include surface features, such as indicating lines or texture, that when extended beyond back side 48 corresponds to the complete and proper coupling of mating members 22, 24. Indicator 214 may alternatively be configured to be flush with back side 48 when a complete and proper coupling between mating members 22, 24 is achieved, or could have a different color that is visible through indicator aperture 56 (FIG. 2) when a complete and proper coupling between mating members 22, 24 is achieved. Thus, indicator 214 can function to indicate when a complete and proper mating between mating members 22, 24 is achieved in a blind connector.

To uncouple mating members 22, 24 an uncoupling force $F_u$ is applied to mating member 22, as shown in FIG. 8. The application of uncoupling force $F_u$ causes lip 146 to engage with second surface 222 of panel 28 and be transferred into lever 26. The transfer of the force into lever 26 causes lever 26 to pivot about pivot pin 114 in the direction shown in FIG. 8. The relative movement causes uncoupling projection 184 to engage with tapered surface 61 and thereby push mating member 22 away from mating member 24. Again, lever 26 provides a relatively large moment arm thereby amplifying uncoupling force $F_u$ resulting in an increase in the effective force being transmitted to uncouple mating members 22, 24. The relative movement between lever 26 and mating member 24 can cause second portion 170 of preset position arm 160 to engage with preset position release 70 in a reverse fashion illustrated in FIGS. 7D through 7A, thereby allowing lever 26 to return to its preset position. In this manner, connector 20 can be reset to allow future coupling of mating members 22, 24.

The engagement arms 140 of each lever 26 act on diagonally-opposed portions of mating member 22. In this manner, the coupling force $F_c$ and uncoupling force $F_u$ can be applied in a somewhat symmetrical manner to stabilize alignment of mating members 22, 24 and facilitate their coupling. The combining of the indicator feature into levers 26 provides for a simple assembly that eliminates the need for extra parts or complexity in connector 20.

The various components of connector 20 can be made from a variety of materials. By way of non-limiting example, levers 26 have resilient and flexible characteristics and, accordingly, can be made of plastic, such as glass-filled polyester, glass-filled nylon, glass-filled PBT, stamped-steel and the like. Mating members 22, 24 can also be made from a variety of materials. By way of non-limiting example, mating members 22, 24 can be made from an insulating material like nylon, PBT, and the like.

While the present teachings have been described with reference to particular illustrations and figures, it should be appreciated that changes can be made to that shown without deviating from the present teachings. For example, mating member 22 could be held stationary while mating member 24 and panel 28 are advanced toward mating member 22 to couple mating members 22, 24 together. Moreover, the male and female terminals that are disposed in mating members 22, 24 may be reversed. Additionally, it may be possible to attach levers 26 to mating member 22 instead of mating member 24. Additionally, the specific shapes shown for mating members 22, 24, levers 26 and the features thereon may be different than those shown and still be within the present teachings. Accordingly, the description is merely exemplary in nature and variations are not to be regarded as a departure from the spirit and scope of the teachings.

What is claimed is:

1. A connector assembly comprising:

a first connector having a section for securing a first plurality of electrical terminals to the first connector, an interior to the first connector, and an opening to the interior opposite the securing section;

a second connector having inner chambers for holding a second plurality of electrical terminals, the second connector complementary to the first connector such that a portion of the second connector can be disposed in the interior of the first connector to interconnect the first and second terminals; and at least one lever having first and second arms disposed on opposite first and second sides of one of the connectors and a bridge member joining the arms across the one connector, the first arm having a pivot aperture disposed on a first pin projecting outwardly from the first side of the one connector, the second arm having a slot longer than the aperture disposed on a second pin projecting outwardly from the second side of the one connector, at least one of the arms having a coupling projection that engages with the other one of the connectors, wherein receipt of the second connector into the interior of the first connector engages the lever which thereby pivots and exerts a force on the coupling projection with the other one of the connectors pulling the second connector further into the first connector and electrically mating the first and second plurality of terminals.

2. The connector assembly of claim 1, further comprising a resilient position preset arm on at least one of the first and second arms, the position preset arm limiting a position of the lever relative to the one connector when engaged with a corresponding position preset projection on the one connector, and the position preset arm engaging with a position preset release projection on the other one of the connectors during the movement of the second connector into the first connector thereby releasing the position preset arm from engagement with the position preset projection.

3. The connector assembly of claim 1, wherein the lever is disposed on the second connector.

4. The connector assembly of claim 1, wherein the second arm slides along the second pin as the lever pivots about the first pin.

5. The connector assembly of claim 1, wherein the second arm extends through a backside of the first connector opposite the opening when the plurality of terminals are electrically mated thereby indicating the mating of the terminals.

6. The connector assembly of claim 1, further comprising a base and wherein the one connector is movably mounted on the base, at least one of the arms having a base engaging projection near the bridge member in contact with the base, and receipt of the second connector into the interior of the first connector exerts force on the base engaging projection from the base to pivot the lever.

7. The connector assembly of claim 6, wherein both arms have a base engaging projection near the bridge member in contact with the base, and receipt of the second connector into the interior of the first connector exerts force on the base engaging projections from the base to pivot the lever.

8. The connector assembly of claim 6, further comprising a lip on the bridge member that engages with an opposite side of the base than the base engaging projection and a decoupling projection on the arm having the coupling projection, the decoupling projection engaging with the other one of the connectors, and wherein pulling of the second connector away from the first connector exerts a force on the lip from the base that engages the decoupling projection with the other one of the connectors, pivots the lever, pushes the second connector away from the first connector and electrically unmates the first and second plurality of terminals.

9. The connector assembly of claim 6, wherein the coupling projection is disposed on an end of the first arm opposite the bridge member.

10. The connector assembly of claim 9, wherein the bridge member is disposed adjacent one end of the one connector and the first pin is adjacent an opposite end of the one connector with the coupling projection on the first arm between the pin and the opposite end of the one connector.

11. The connector assembly of claim 1, wherein:

the one connector is the second connector, the second connector is movably mounted on a base, the second connector having opposite first and second sides extending between two ends of the second connector, the first and second pins are disposed on the respective first and second sides adjacent opposite ends of the second connector;

the at least one lever is two levers, each lever having first and second arms for fitting around the sides of the second connector and a bridge member joining the arms across the second connector, the first arm of each lever having an aperture, the second arm of each lever having a slot longer than the aperture, at least one of the arms of each lever having a base engaging projection near the bridge member in contact with the base, the levers being mounted on the pins of the second connector such that the aperture of each first arm receives the pin outward from a side of the second connector and the slot of each second arm receives the pin such that each second arm is sandwiched between a side of the second connector and a first arm; and receipt of the second connector into the interior of the first connector exerts force on the base engaging projections from the base to pivot the levers, causing the levers to pull the second connector further into the interior of the first connector and electrically mate the first and second plurality of terminals.

12. The connector assembly of claim 11, wherein each first arm has a coupling projection that engages with the first connector, the coupling projections disposed between the aperture and an end of the first arm opposite the bridge member, and receipt of the second connector into the interior of the first connector exerts force on the base engaging projections from the base to pivot the levers causing the coupling projections to engage with the first connector and pull the second connector further into the interior of the first connector and electrically mate the first and second plurality of terminals.

13. The connector assembly of claim 11, wherein the bridge member of each lever is disposed adjacent an opposite end of the second connector from the pin on which its associated first arm is disposed.

14. A connector assembly comprising:

a first connector having a first side with a section having a plurality of terminal openings therethrough for securing a first plurality of electrical terminals to the first connector, an interior within the first connector, and a mating opening to the interior opposite the securing section;

a second connector sized to be inserted into the interior of the first connector through the mating opening, the second connector having a second side with a plurality of openings therethrough leading to chambers for holding a second plurality of electrical terminals; and an indicator coupled to one of the connectors, the indicator passing into an opening in an associated one of the first and second sides of the other one of the connectors when the first and second plurality of terminals are mated together thereby indicating electrical mating of the terminals.

15. The connector assembly of claim 14, further comprising at least one lever pivotally mounted on the second connector and arranged to be at least partially received in the interior of the first connector, the at least one lever being operable to draw the second connector further into the interior of the first connector to electrically mate the first aid second plurality of terminals and wherein the indicator is a portion of the at least one lever.

16. The connector assembly of claim 14, wherein the indicator extends into the opening and is flush with the associated one of the first and second sides of the other one of the connectors when the first and second plurality of terminals are mated together thereby indicating electrical mating of the terminals.

17. The connector assembly of claim 14, wherein the indicator extends through the opening and at least partially beyond the associated one of the first and second sides of the other one of the connectors when the first and second plurality of terminals are mated together thereby indicating electrical mating of the terminals.

18. The connector assembly of claim 14, wherein the indicator is a different color than a color of the associated one of the first and second sides of the other one of the connectors.

19. The connector assembly of claim 14, wherein the indicator is coupled to the second connector, is at least partially received in the interior of the first connector, and extends into an opening in the first side of the first connector when the terminals are mated together.

20. The connector assembly of claim 19, wherein the indicator extends through a guide opening in the second connector and into the opening in the first side of the first connector when the terminals are mated together.

21. A connector assembly comprising:

a first connector having a section for securing a first plurality of electrical terminals to the first connector, an interior within the first connector, and an opening to the interior opposite the securing section;

a second connector sized to be inserted into the interior of the first connector, the second connector having chambers for holding a second plurality of electrical terminals;

an indicator coupled to one of the connectors, the indicator passing into an opening in a side of the other one of the connectors when the first and second plurality of terminals are mated together thereby indicating electrical mating of the terminals; and at least one lever pivotally mounted on the second connector and arranged to be at least partially received in the interior of the first connector, the at least one lever being operable to draw the second connector further into the interior of the first connector to electrically mate the first and second plurality of terminals, the indicator is a portion of the at least one lever, the at least one lever has first and second arms extending along opposite sides of the second connector and a bridge member joining the arms across the second connector, the first arm being operable to draw the second connector further into the interior of the first connector and the second arm having the indicator at an end thereof and being completely unassociated with the drawing of the second connector further into the interior of the first connector.

22. A connector assembly comprising:

a first connector having a section for securing a first plurality of electrical terminals to the first connector, an interior within the first connector, and an opening to the interior opposite the securing section;

a second connector sized to be inserted into the interior of the first connector, the second connector having chambers for holding a second plurality of electrical terminals;

an indicator coupled to one of the connectors, the indicator passing into an opening in a side of the other one of the connectors when the first and second plurality of terminals are mated together thereby indicating electrical mating of the terminals;

at least one lever pivotally mounted on the second connector and arranged to be at least partially received in the interior of the first connector, the at least one lever being operable to draw the second connector further into the interior of the first connector to electrically mate the first and second plurality of terminals, the indicator is a portion of the at least one lever, the at least one lever has first and second arms extending along opposite sides of the second connector and a bridge member joining the arms across the second connector, the first arm being operable to draw the second connector further into the interior of the first connector and the second arm having the indicator at an end thereof, wherein the at least one lever is two levers with the first arms of each lever disposed on opposite sides of the second connector and the bridge members extending across the second connector adjacent opposite ends of the second connector.

23. The connector assembly of claim 22, wherein the first arms pivot about pivot pins on the second connector and the second arms slide along the pivot pins.

24. A connector assembly comprising:

a first connector having a section for securing a first plurality of electrical terminals to the first connector, an interior within the first connector, and an opening to the interior opposite the securing section;

a second connector sized to be inserted into the interior of the first connector, the second connector having chambers for holding a second plurality of electrical terminals; and an indicator coupled to one of the connectors, the indicator passing into an opening in a side of the other one of the connectors when the first and second plurality of terminals are mated together thereby indicating electrical mating of the terminals, wherein the indicator is one of two indicators that each extend into separate openings in a side of the other one of the connectors adjacent opposite sides of the other one of the connectors when the first and second plurality of terminals are mated together thereby indicating electrical mating of the terminals.

25. A connector assembly comprising:

a first connector having a section for securing a first plurality of electrical terminals to the first connector, an interior within the first connector, and an opening to the interior opposite the securing section;

a second connector sized to be inserted into the interior of the first connector, the second connector having chambers for holding a second plurality of electrical terminals; and an indicator coupled to one of the connectors, the indicator passing into an opening in a side of the other one of the connectors as well as an opening in the connector to which the indicator is coupled, the indicator thereby passing through openings in both of the first and second connectors when the first and second plurality of terminals are mated together thereby indicating electrical mating of the terminals.

26. The connector assembly of claim 25, further comprising at least one lever pivotally mounted on the second connector and arranged to be at least partially received in the interior of the first connector, the at least one lever being operable to draw the second connector further into the interior of the first connector to electrically mate the first and second plurality of terminals and wherein the indicator is a portion of the at least one lever.

27. The connector assembly of claim 25, wherein the indicator extends through a guide opening in the second connector and into the opening in the side of the first connector when the terminals are mated together.

* * * * *